US007302931B2

(12) United States Patent
Saito et al.

(10) Patent No.: US 7,302,931 B2
(45) Date of Patent: Dec. 4, 2007

(54) MOTOR-DRIVEN THROTTLE VALVE CONTROL DEVICE FOR INTERNAL COMBUSTION ENGINE

(75) Inventors: Yasuo Saito, Hitachinaka (JP); Takahiro Shimura, Mito (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/403,942

(22) Filed: Apr. 14, 2006

(65) Prior Publication Data

US 2006/0231072 A1 Oct. 19, 2006

(30) Foreign Application Priority Data

Apr. 14, 2005 (JP) ..... 2005-116405

(51) Int. Cl.
*F02D 11/10* (2006.01)

(52) U.S. Cl. ..... 123/396; 123/399

(58) Field of Classification Search ..... 123/361, 123/396, 399
See application file for complete search history.

(56) References Cited

U.S. PATENT DOCUMENTS 5,429,090 A 7/1995 Kotchi et al.
6,386,178 B1 * 5/2002 Rauch ..... 123/399
6,966,297 B2 11/2005 Wayama et al.
2002/0078923 A1 6/2002 Torii
2005/0178359 A1 8/2005 Wayama et al.

FOREIGN PATENT DOCUMENTS

EP 1 179 665 B1 5/2003
EP 1 099 842 B1 7/2003
JP 2002-256894 A 11/2002
JP 2004-169626 A 6/2004
JP 2004-169627 A 6/2004

* cited by examiner

*Primary Examiner*—T. M. Argenbright
(74) *Attorney, Agent, or Firm*—Crowell & Moring LLP

(57) ABSTRACT

A spring to ensure default opening is constituted by a single piano wire where a return spring with a larger coil diameter and a default spring with a smaller coil diameter are connected via a connection arm formed with a spring hook. The spring with a smaller coil diameter is inserted in the spring with a larger coil diameter thereby the springs are overlapped in an axial direction as a duplex-winding spring structure. Further, a magnetic sensor is provided in a position inside the both spring with a larger coil diameter and spring with a smaller coil diameter.

10 Claims, 7 Drawing Sheets

DEFAULT OPENING POSITION

FULL-CLOSED (MINIMUM OPENING) POSITION

MOTOR-DRIVEN THROTTLE VALVE CONTROL DEVICE FOR INTERNAL COMBUSTION ENGINE

CLAIM OF PRIORITTY

The present application claims priority from Japanese application serial no. 2005-116405, filed on Apr. 14, 2005, the content of which is hereby incorporated by reference into this application.

BACKGROUND OF THE INVENTION

The present invention relates to a throttle valve control device for controlling an intake air flow rate in an internal combustion engine in response to engine operating conditions, and more particularly, to so-called a limp-home mode drive mechanism upon failure of a motor-driven throttle valve control device.

In a motor-driven throttle valve control device in which a throttle valve is driven with a DC motor or a stepping motor etc. (hereinbelow, referred to as a motor), it is necessary to have a fail-safe function to, even when a control circuit or the motor is broken, keep a throttle valve opening capable of performing a vehicle limp-home travel for e.g. moving the vehicle to a safe place.

Further, for prevention of so-called throttle valve lock state (sticking state), where the throttle valve can not be opened with a motor torque any more upon engine starting and which is caused by for example throttle valve freezing or adhering of a viscous substance on an intake passage wall surface, a fail-safe function to keep the predetermined throttle valve opening position more than a full-closed position upon engine key off time (in other words, when the electric motor-driven actuator is not energized) is required. The opening for realizing such limp-home function and valve lock (stick) prevention function are called as e.g. an limp-home opening, an initial opening or a default opening. This technique is disclosed in Japanese Published Unexamined Patent Application No. 2002-256894.

In the above-described conventional motor-driven throttle valve control device, one spring member, in which a first spring served as a default spring and a second spring served as a return spring are integrally formed by a length of spring wire, is used for the device. Further a hook is formed between the first spring and the second spring. In an opening direction of the throttle valve, a force of the first spring exerts on a throttle shaft until the hook of the spring member comes into contact with a default stopper of a throttle body. In a closing direction of the throttle valve, a force of the second spring acts on the throttle shaft until both side surfaces of the opener member are held with the hook of the spring member and the other end. In this arrangement, limp-home mode when current supply for the actuator is stopped due to some factor is achieved by one opener member and one spring member.

However, in this arrangement, as the two members (return spring and default spring) constituting one spring are serially arranged in an axial direction, the axial length is prolonged.

SUMMARY OF THE INVENTION

The object of the present invention is to provide a motor-driven throttle valve control device where the axial length of a spring mechanism is short.

To attain the above object, with regard to the return spring and default spring, the present invention provides an arrangement where a duplex-winding spring (double coil spring arrangement) with different coil diameters (a spring where a spring with a smaller coil diameter is located inside a spring with a larger coil diameter thereby the springs are overlapped in an axial direction) is formed with a length of continuous spring wire. The spring having one diameter has a return spring function to apply a spring force in a closing direction to the throttle valve, while the spring having the other diameter has a default spring function to apply a spring force on the default opening side from a full-closed position to the throttle valve.

DETAILED DESCRIPTION OF THE INVENTION

Figure 1:
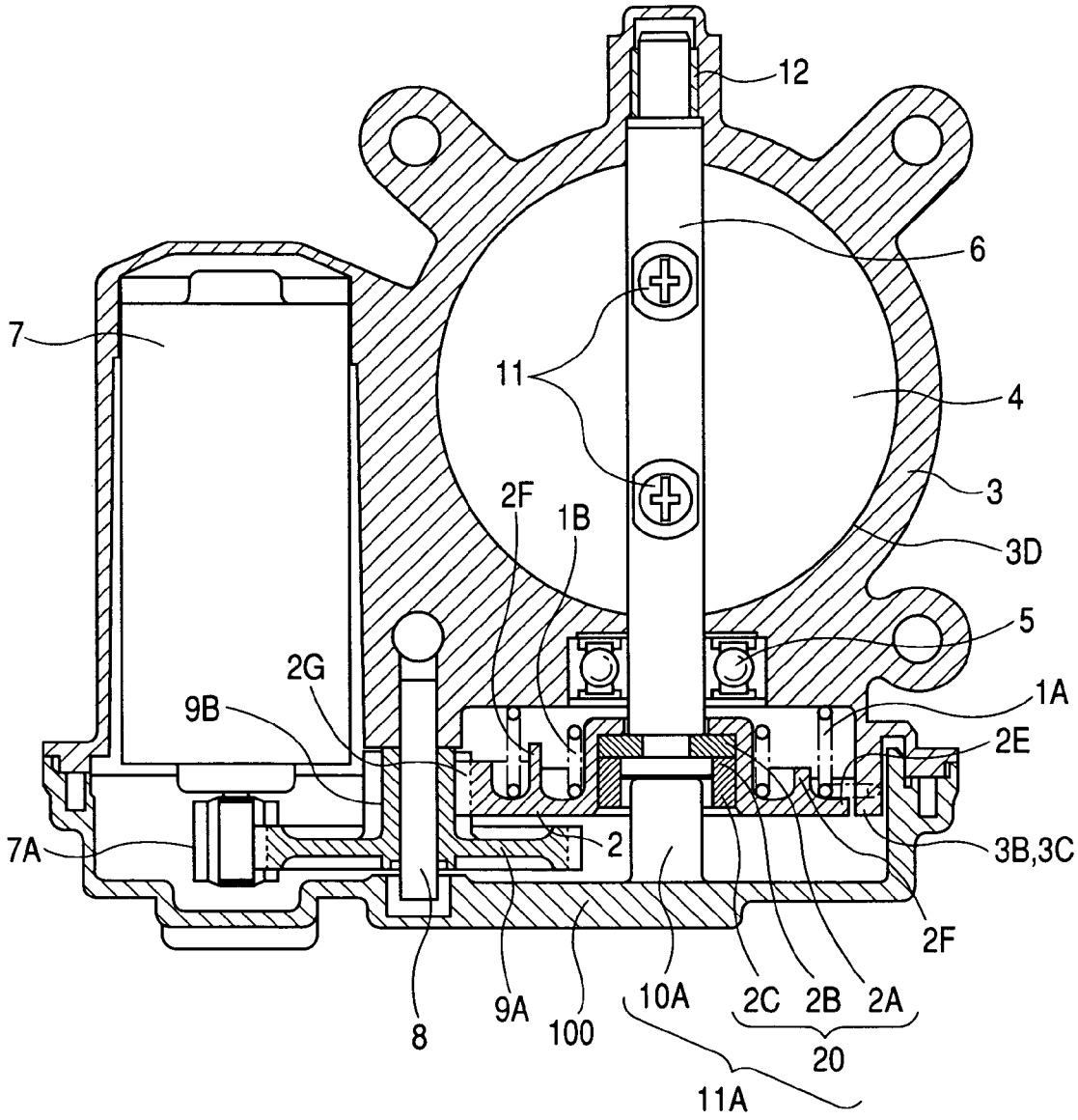
FIG. 1 is a cross-sectional view of the motor-driven throttle valve control device and a perspective view of the spring.

An embodiment of a motor-driven throttle valve control device with an improved default opening setting mechanism will be described in detail with reference to FIG. 1 to FIG. 7. FIG. 1 is a cross-sectional view of the motor-driven throttle valve control device, FIG. 2, an explanatory view of a spring, FIGS. 3, 4 and 5, a partial cross-sectional perspective view, an entire external perspective view and an exploded perspective view of a spring assembly, FIG. 6, a perspective view of the spring, and FIG. 7, a perspective view for explaining assembling state of a throttle gear, a throttle shaft and a throttle body, and a positional relation between the throttle gear and a stopper of the throttle body or a stopper.

Embodiment 1

An outer ring of a ball bearing 5 is provided to a throttle body 3, and a throttle shaft 6*d* is fixed to an inter ring of the ball bearing 5.

An end of the throttle shaft 6 is rotatably held with a plane bearing 13 provided to the throttle body 3. A throttle valve 4 is fixed to the throttle shaft 6 with screws 11.

Thus the throttle valve 4 is rotatably installed in an intake passage formed inside a bore wall 3D of the throttle body 3.

A throttle gear 2 is fixed on the throttle shaft 6 on the ball bearing 5 side.

A spring member 1 (1A, 1B) is held around an axis of the throttle shaft 6. The rotation force of the throttle gear 2 is transmitted from a motor gear 7A fixed to an output shaft of a motor 7 via an intermediate gear 9 rotatably held with a gear shaft 8.

In this embodiment, a brush type DC motor is used as the motor 7, however, an actuator which can generate a rotation torque, such as a brushless motor, a step motor, a torque motor or an ultrasonic motor may be used.

As the throttle gear 2 is rotated by the motor 7 via the motor gear 7A, the intermediate gear 9 and the throttle gear 2, an effective area between the throttle valve 4 and the bore wall 3D (that is, a cross-sectional area of the intake passage) is changed, and an air flow rate supplied to the engine is controlled. The motor 7 and the magnetic sensor to be a non-contact throttle position sensor 11A are electrically connected with an external device (not shown in Figs.) via a connector (not shown in Figs.) integrally mold-formed with a resin cover 100 via connection terminals of electric conductor (not shown in Figs) mold-formed in the resin cover 100.

The spring member 1 is provided between an end surface of the throttle gear 2 as a final stage gear on the throttle body 3 side and a side wall of the throttle body 3.

The spring member 1 is comprises of a larger coil diameter spring 1A and a smaller coil diameter spring 1B which are continuously (in other wards, integrally) formed in a length of spring wire. One spring 1B with a smaller coil diameter is located inside another 1A with a larger coil diameter (that is, a double coil spring arrangement (a duplex-winding arrangement) where the smaller coil diameter spring 1A is inserted inside the larger coil diameter spring thereby those springs are overlapped in an axial direction, is formed).

The larger coil diameter spring 1A is formed as a return spring 1A, and as described later, its one end is bent in hook shape to be a hook 1E of the return spring. The hook 1E is hooked on a return spring stopper 3C also served as a full-opening stopper for the throttle valve in the throttle body 3.

The smaller coil diameter spring 1B forms a default spring 1B, and its one end is bent in hook shape to be a hook 1D of the default spring 1B. The hook 1D is hooked on a stopper (projection) 2D provided on the throttle gear 2.

Other ends of the return spring (larger coil diameter spring) 1A and the default spring (smaller coil diameter spring) 1B are connected integrally with each other via a spring hook 1C which is formed integrally with those springs 1A and 1B. The spring hook 1C projects outside the larger coil diameter spring 1A so as to be stopped on the default stopper 3B outside the larger coil diameter spring 1A when the throttle valve 4 is turned up to the default opening position. The spring hook 1C comprises a short arm part 1C1 on the side of a larger coil diameter spring 1A and a long arm part 1C2 on the side of a smaller coil diameter spring 1B. The short arm part 1C1 of the spring hook 1C between the return spring 1A and the default spring 1B comes into contact with a spring stopper 3B also served as a default stopper when the throttle valve 4 comes to the default position.

More concretely, the spring member 1 is configured by a length of spring wire such as a single piano wire where the return spring 1A with a larger coil diameter and the default spring 1B with a smaller coil diameter are continued to each other via a connection arm parts 1C1 and 1C2 as the spring hook 1C.

The spring hook 1C is configured as follows when viewed from the larger coil diameter spring (return spring) 1A. The short arm part 1C1 to be the larger coil diameter spring (return spring) side of the spring hook 1C is bent outward in a spring radial direction within the same plane as the winding plane of the spring 1A at an end of the spring 1A (positioned in an intermediate portion between both springs). An end of the short arm part 1C1 further is bent back toward the smaller larger coil diameter spring (default spring) 1B within the same plane as the winding plane, and continued to an end of the spring 1B through the long arm part 1C2 to be the smaller larger coil diameter 1B side of the hook 1C. Accordingly, since the short arm part 1C1, as an edge of the plane formed by the long arm part 1C2, the short arm part 1C1 and a bend portion connecting the both arm parts, is stopped by the spring stopper 3B, the rigidity of the stopped part (short arm part) 1C1 becomes extremely high.

In the other words, the spring hook 1C has a hair pin shaped projection projecting outside those different diameter springs (1B, 1A) served as the default spring and the return spring.

The spring 1 is installed in cylindrical (doughnut-shaped) space formed between the outer periphery of a rotor 20 (for a throttle sensor) of the throttle gear 2 and inside of gear teeth 2G of the throttle gear 2. Thus, the spring member 1 is held inside and outside of a spring holder 2F as a semi-cylindrical member formed between the outer periphery of the rotor 20 and inside of the gear teeth 2G of the throttle gear 2.

As the spring holder 20F is mold-formed together with resin-molded gear, the spring holder is formed with the same resin material. Accordingly, the inner and outer peripheries of the spring 1 are surrounded with resin.

The spring hook 1C is formed as a connection arm for connecting the default spring 1B with a smaller coil diameter and the return spring 1A with a larger coil diameter to each other. In other words, it comprises the long arm part 1C2 extending outward in the radial direction from an end of the default spring 1B and the short arm part 1C1 connected with the return spring 1A with a larger coil diameter with the hair pin bend portion therebetween. The long arm parts 1C2 abuts on a spring engagement end surface 2E of a projection integrally formed by resin molding with the throttle gear 2 as a final stage gear. More particularly, the projection with the spring engagement end surface 2E is inserted into a loop of the hook 1C, and the end surface 2E of the projection is capable of engaging the inside of the long arm part 1C2 within a range between the default position of the throttle valve and the full opening position thereof.

According to this embodiment, since, in the single hook 1C, the short arm part 1C1 has a function for being stopped (engaging) with the spring stopper 3B also served as default stopper, and the long arm part 1C2 has a function for contacting with the spring engagement end surface 2E and thereby transmitting the rotational force of the throttle gear to the return spring 1A, such an arrangement is rational.

Figure 3:
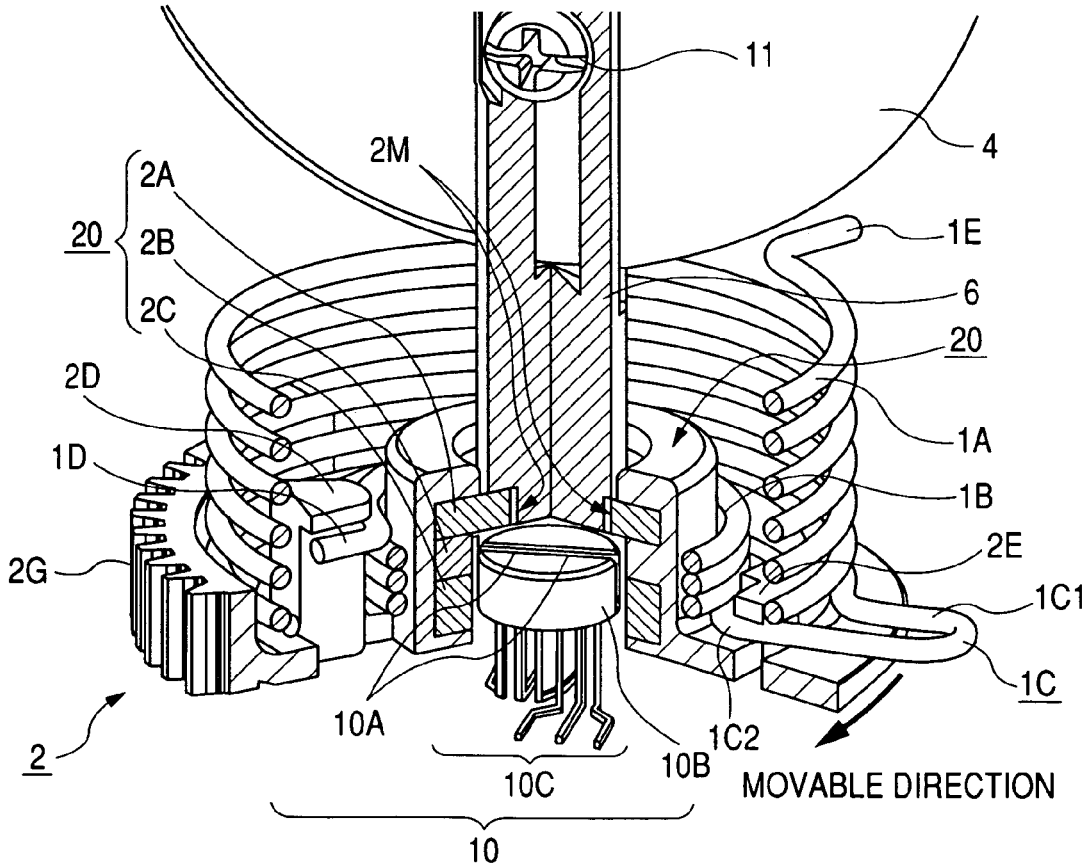
FIG. 3 is a partial cross-sectional perspective view of the spring assembly.
Figure 4:
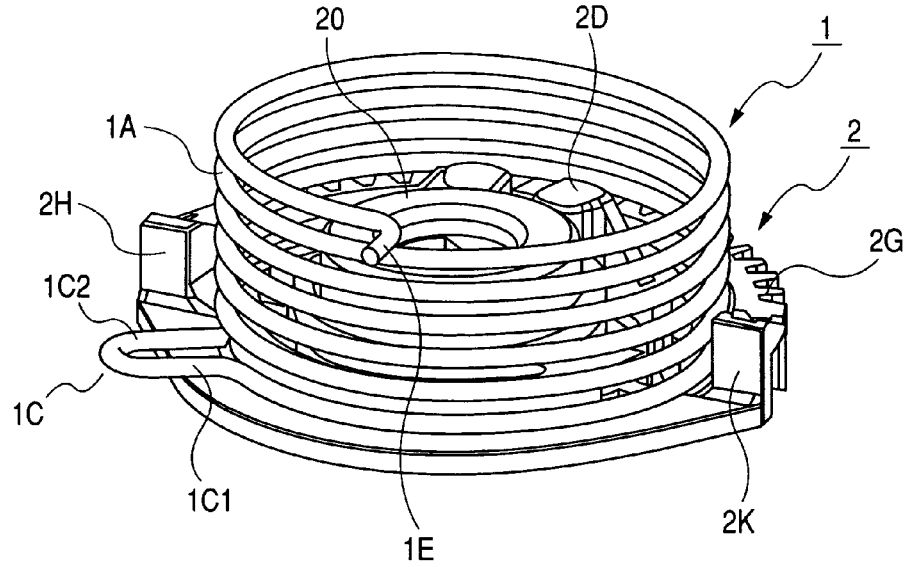
FIG. 4 is an entire external perspective view of the spring assembly.
Figure 5:
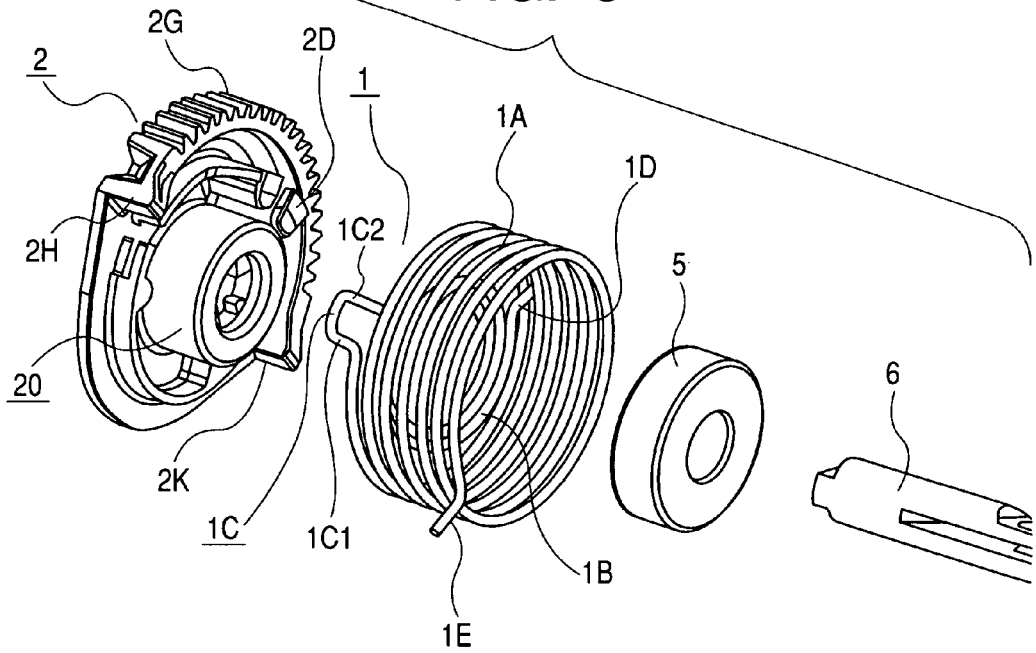
FIG. 5 is an exploded perspective view of the spring assembly.
Figure 6:
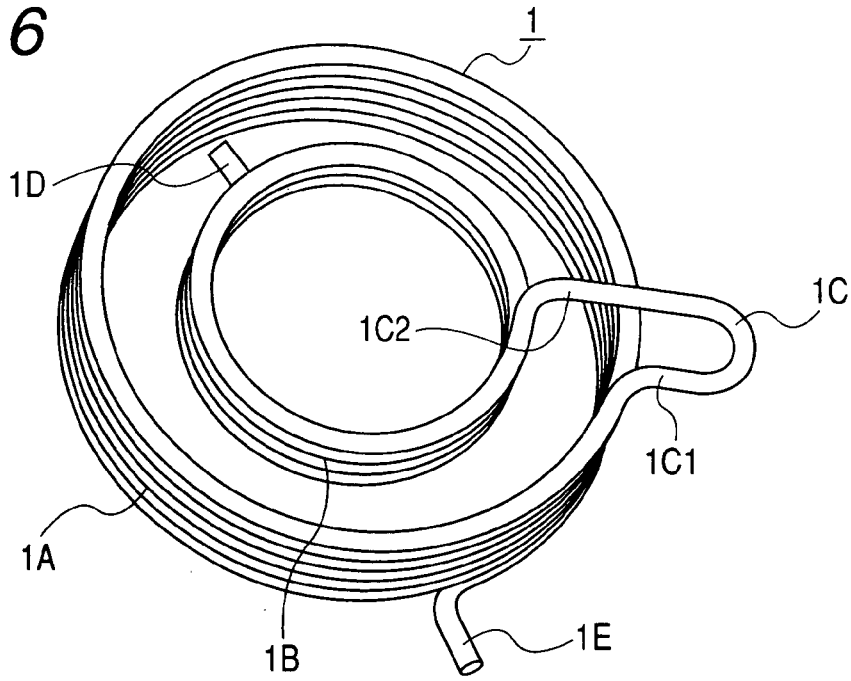
FIG. 6 is a perspective view of the spring.
Figure 7:
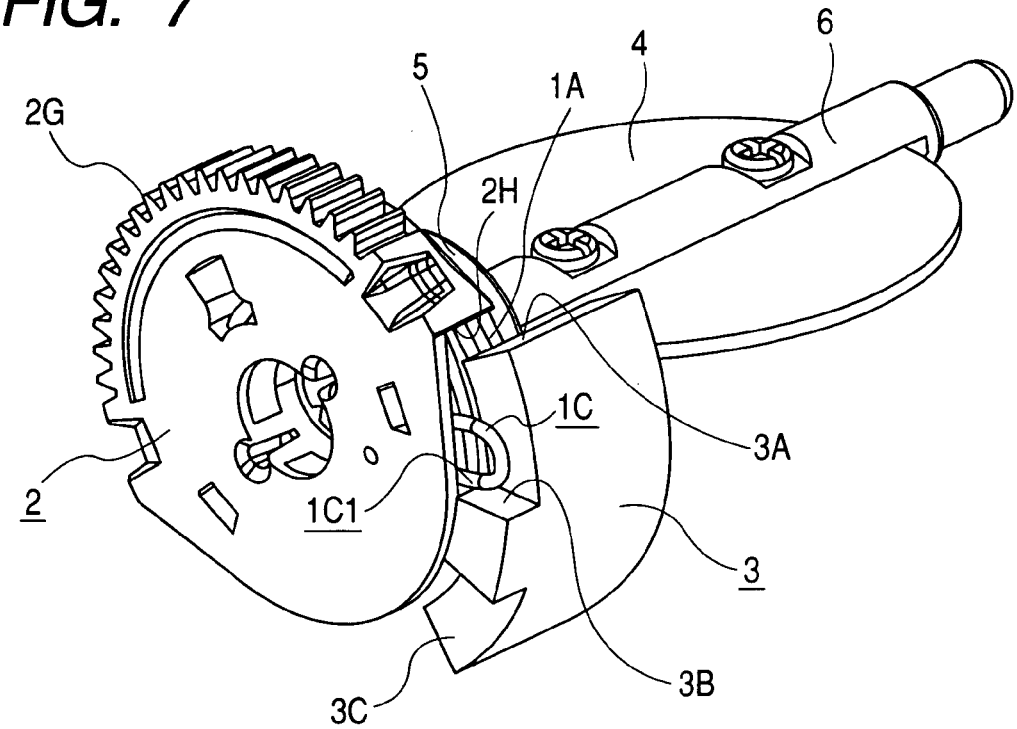
FIG. 7 is a perspective view for explaining the status of assembly of the throttle gear, the throttle shaft and the throttle body, and the positional relation between the throttle gear and the stopper of the throttle body or the stopper.

The spring hook 1C is relatively movable and rotatable away from the spring engagement end surface 2E to the throttle gear indicated with an arrow in FIG. 3.

The hook 1D formed at the open end of the default spring 1B, on which preload is applied in its rotation direction, is hooked on the projection 2D of the throttle gear 2. The hook 1E of the return spring formed at the open end of the return spring 1A, on which preload is applied in its rotation direction, is hooked on the spring stopper 3C of the throttle body 3.

According to the above arrangement, the return spring 1A and the default spring 1B can be intensively arranged between the throttle gear provided on the throttle shaft and the throttle body wall, thus rationalization of throttle members' space can be attained.

Especially, according to the embodiment, the return spring and the default spring are arranged to be overlapped with each other (the spring with a smaller coil diameter is located inside the spring with a larger coil diameter), thereby the arrangement space of the spring in an axial direction can be reduced, and by extension, a gear case and the entire throttle body can be down sized and light-weighted.

Further, the open end of one spring is fixed at the throttle gear in a status where the spring has a preload, and the spring hook between different coil diameter springs rotatably with respect to the throttle gear. In this arrangement, when a part of at least one spring is fixed to the throttle gear, the throttle gear can integrally hold the both different coil diameter springs connected via the spring hook.

Thus, the spring can be previously assembled with the throttle gear, which contributes to rationalization of assembly.

Further, as the spring 1 is subjected to the assembly process in a status where it is attached to the throttle gear 2, the number of parts handled at the assembly process can be reduced, and the assembly can be improved.

Further, in the present embodiment, only the end surface of the spring is in contact with the throttle body, but most of the inner and outer peripheries of the spring face the resin-molded part of the throttle gear 2. Accordingly, even when the spring rubs against the surrounding wall surface and produces friction, high mechanical friction which occurs upon metal-to-metal contact does not occur. Further, metal powder is not produced.

In the throttle gear 2, a plate 2A, magnets 2B and yokes 2C are insert-molded by resin-molding, thereby the rotor 20 in a ring shape of the magnetic sensor for sensing a rotation angle of the throttle shaft 6 is formed.

More particularly, the rotor 20 having the doughnut shaped plate 2A of magnetic material, the two half-moon shaped magnets 2B and the two half-moon shaped yoke 2C is resin insert-molded together with the gear teeth 2G of the throttle gear 2.

The metal plate 2A, inserted by resin-molded in the throttle gear 2, is fitted to an end side portion 2M of the throttle shaft 6, and fixed by laser welding. As the fixing of both members, caulking, screwing, nut-fixing, or welding may be performed. A sensing unit 10 of the magnetic sensor 11A is provided inside the rotor 20, thereby a rotation angle sensor for the motor-driven throttle valve control device is configured.

The hall IC sensing unit 10 fixed to the resin cover 100 is provided in non-contact state inside the ring rotor.

That is, the magnetic sensor 11A for sensing the rotation angle of the throttle shaft 6 (in other words, the rotation angle of the throttle gear 2 or the throttle valve 4) is configured by the ring rotor 20 fixed to the throttle shaft 6 and the hall IC detection unit 10 fixed to the resin cover 100.

In the embodiment, two hall ICs 10A are used in the sensing unit 10, however, the unit may be configured by a hall device, a magneto resistive element, or inductance or contact-resistance rotation angle sensor.

The two hall ICs 10A are located between two semi-cylindrical stators 10B, and three terminals (power, signal and earth) of the respective hall ICs 10A are connected to conductors provided in resin cover 100 by insert molding. The conductors are connected with a connector for external connection. The connector is integrally formed with the cover 100.

In the present embodiment, the magnetic sensor 11A is used as the rotation angle sensor. In the case of the magnetic sensor 11A, if no consideration of magnetic noises, there is a problem that its output is changed due to influence of external magnetism such as terrestrial magnetism and a sensing error is caused. In the present embodiment, the springs 1A and 1B of piano wire as ferromagnetic material are provided in duplex winding (double coil spring arrangement) around the outer periphery of the rotor 20 having the plate 2A, the magnets 2B and the yokes 2C which constituting the magnetic sensor 11A and the magnetic circuit. The influence of the terrestrial magnetism can be reduced by the effect of the magnetic shields of the springs 1A and 1B, and as a result, the output error of the magnetic sensor 11A can be reduced, and by extension, the accuracy of the air flow amount control by the electric motor-driven throttle system can be improved.

Figure 2:
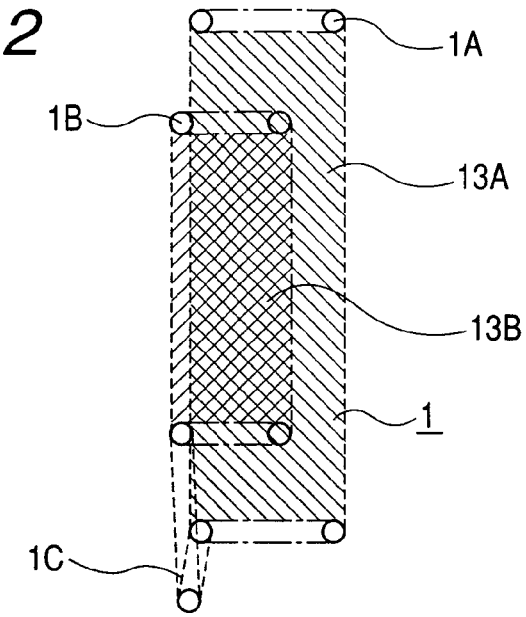
FIG. 2 is an explanatory view of the spring.

FIG. 2 shows an installation range 13 for the magnetic sensor 11A. In the figure, a double hatched area 13B indicates an area inside both of the large spring 1A and the small spring 1B. A single hatched area 13A indicates an area inside only the large spring 1A. As long as the magnetic sensor 11A is located within areas 13A or 13B, the influence of the terrestrial magnetism can be reduced. Especially, in the area 13A, the influence of the terrestrial magnetism can be further reduced by double shielding effect, thereby the accuracy can be improved.

Further, the effect is not limited to the terrestrial magnetism, but the influence of high frequency noise due to power chopper control in motor control can also be reduced.

Figure 8A:
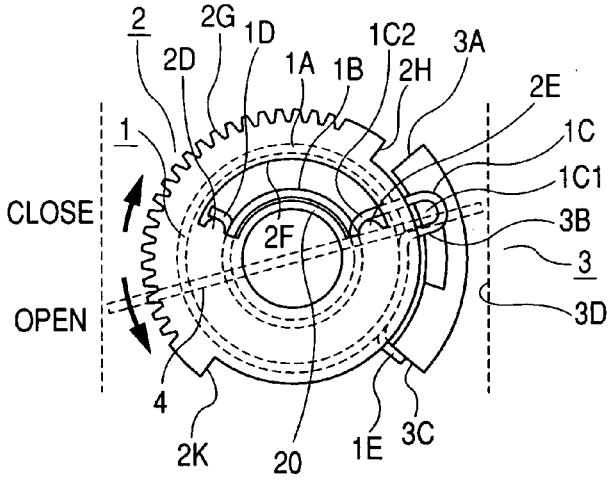
FIG. 8 is a first status view for explaining the operation of the working example in FIGS. 1 to 7.
Figure 8B:
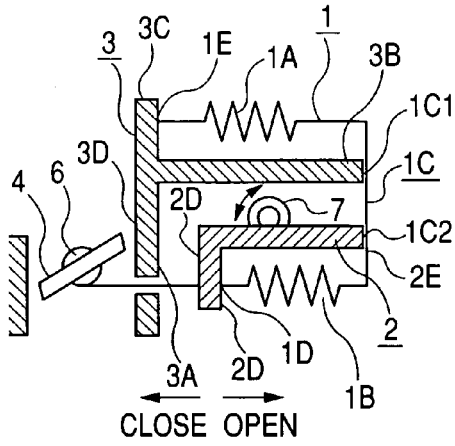
Figure 9A:
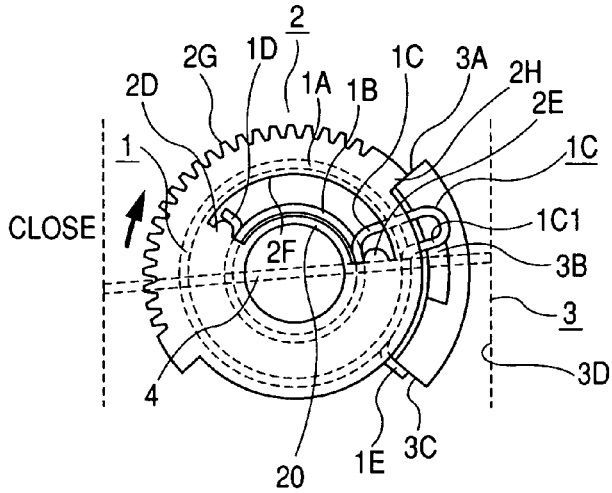
FIG. 9 is a second status view for explaining the operation of the working example in FIGS. 1 to 7.
Figure 9B:
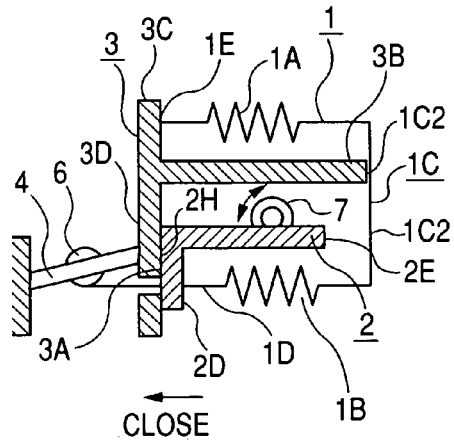
Figure 10A:
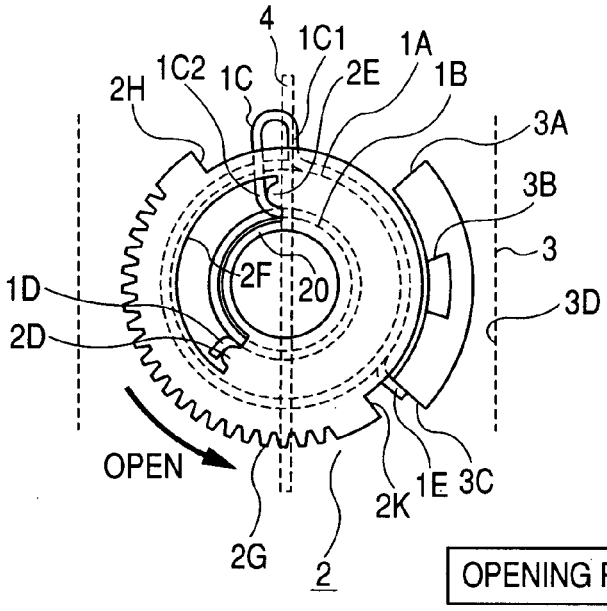
FIG. 10 is a third status view for explaining the operation of the working example in FIGS. 1 to 7.
Figure 10B:
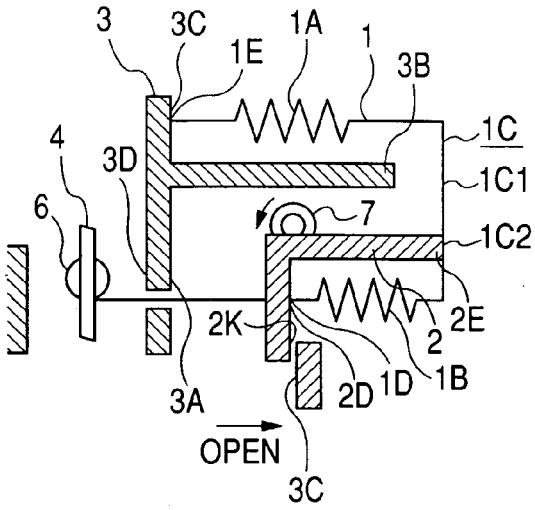

FIGS. 8 to 10 are partial perspective views in the direction of the throttle gear 2 in FIG. 1 when the cover 100 is removed.

FIG. 8(*a*) is a front view showing a status where the motor is unenergized, and the throttle valve 4 is positioned in a default opening as an initial opening. FIG. 8(*b*) is a principle diagram equivalently illustrating FIG. 8(*a*).

FIG. 9(*a*) is a front view showing a status where the throttle valve 4 is driven by the motor up to a full-closed position. FIG. 9(*b*) is a principle diagram equivalently illustrating FIG. 9(*a*).

FIG. 10(*a*) is a front view showing a status where the throttle valve 4 is driven by the motor up to a full-open position. FIG. 10(*b*) is a principle diagram equivalently illustrating FIG. 10(*a*).

In FIG. 8(*a*), the hook 1D at one end of the default spring 1B is hooked on the projection 2D formed on the throttle gear 2.

The long arm part 1C2 of the spring hook 1C positioned at the other end of the default spring 1B is hooked on the spring engagement end surface 2E of the projection formed on the throttle gear 2.

In this status, as the default spring 1B is wound up with a force not to move away from the throttle gear 2, and the spring 1 is fixed to the throttle gear 2 with the force.

On the other hand, the hook 1E at the open end of the return spring 1A, in screwed status, is hooked on the spring stopper 3C of the throttle body 3.

The short arm part 1C1 of the spring hook 1C positioned at the other end of the return spring 1A is pressed against the spring stopper 3B of the throttle body 3 with a returning force acting in a clockwise direction of the return spring 1A, and a torque in a closing direction is applied to the throttle gear 2.

Note that as the returning force by the return spring 1A is received with the spring stopper 3B when the short arm part 1C1 of the spring hook 1C is stopped on the spring stopper 3B of the throttle body 3, the throttle gear 2 cannot be further close beyond this position, thereby it is stopped in this position, i.e., the default opening position.

In this manner, when the motor 7 is not energized, the rotation angle of the throttle gear 2 is kept to an opening in a neutral point of the throttle valve 4 (initial opening, default opening or limp-home opening). FIG. 8(*b*) is a principle diagram where the return spring 1A and the default spring 1B of the spring 1 are replaced with extension springs.

When the motor 7 is energized and the throttle gear 2 is rotated in a counterclockwise direction (an opening direction of the throttle valve 4) from the status of FIG. 8, the end surface 2E of the projection on throttle gear 2 hooks the long arm part 1C1 (other end) of the return spring 1A and rotates together with the long arm part, in the counterclockwise direction.

At this time, as the hook 1E at one end of the return spring 1A is fixed to the spring stopper 3C and is not moved, the return spring is wound up, and the returning force is increased as the opening of the throttle valve is increased.

When the throttle gear has been rotated up to the full-open position of the throttle valve, a cutout end surface 2K at one end of the throttle gear 2 contacts with the stopper 3C of the throttle body 3, thereby the rotation of the rotation in the opening direction is regulated. Generally, control of the throttle valve is performed so that the gear is stopped in an electrical controlled full-open position immediately before the stopper 3C. During this operation, the both ends of the default spring 1B are rotated together with the spring stopper projection 2D and 2E of the throttle gear. Accordingly, during this operation, no change occurs in the default spring.

This status is shown in FIGS. 10(*a*) and 10(*b*).

On the other hand, when the motor 7 is energized so that the throttle gear 2 is rotated in the clockwise direction from the default opening position (FIG. 8), the spring stopper projection 2D causes the hook 1D at one end of the default spring to rotate in the clockwise direction.

At this time, as the short arm part 1C1 of the spring hook 1C as the other end of the default spring 1B is stopped on the spring stopper (default stopper) 3B of the throttle body 3, the spring hook 1C cannot be rotated to full closing position any more.

As a result, the spring engagement end surface 2E is moved away from the long arm part 1C2 of the spring hook 1C, and independently rotated in the clockwise direction. As a result, the default spring 1B is wound up. Thus, the torque for returning in the counterclockwise direction (valve opening direction) is accumulated as the rotation is increased in the clockwise direction.

When the gear has been rotated to the full-closed position, the cutout end surface 2H at the other end of the throttle gear 2 contacts with the stopper 3A as a full-close stopper of the throttle body 3, thereby the rotation in the closing direction is regulated. Generally, control of the throttle valve is performed so that the gear is stopped in an electrical full-closed position immediately before the stopper 3A.

This status is shown in FIGS. 9(*a*) and 9(*b*).

In the above operation, when the default spring 1B is wound up, it slides on the outer periphery of the rotor 20 positioned in the inner periphery of the spring, however, the surface of the rotor 20 is resin, no friction occurs upon contact, or no metal powder is produced.

Further, the inner periphery of the gear teeth 2G surrounding the outer periphery of the return spring 1A and a cylindrical guide 2F for guide the inner periphery of the return spring 1A can be also described as the same matter. Namely, even when the return spring 1A slides on these members upon winding off or up of the spring, as the inner periphery of the gear teeth 2G and the inner/outer peripheries of the cylindrical guide 2F are made of resin, no friction occurs, or no metal powder is produced by chipping.

Second Embodiment 2

Figure 11:
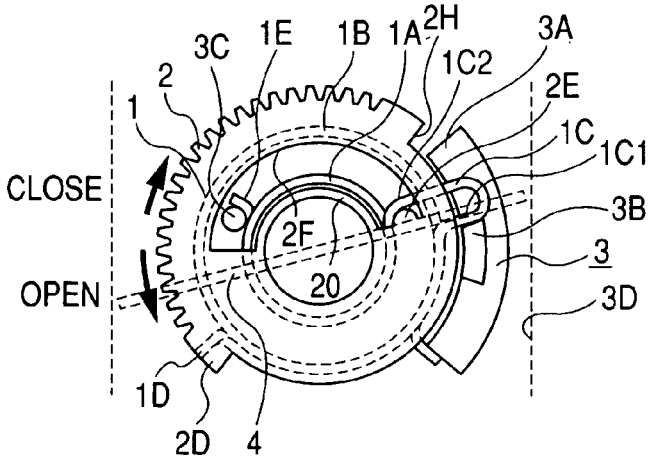
FIG. 11 is an operation explanatory view for explaining the second working example.

FIG. 11 shows a second embodiment of the present invention. Regarding to the above-described FIG. 8(*a*), in the present embodiment, the spring with a smaller coil diameter is used as the return spring 1A, while the spring with a larger coil diameter, as the default spring 1B.

In this case, the hook 1E as an open end of the return spring 1A with a smaller coil diameter is hooked on the spring stopper 3C formed on the throttle body 3.

On the other hand, the hook 1D as an open end of the default spring 1B with a larger coil diameter is hooked on the stopper projection 2D formed on the throttle gear 2.

When the motor is energized so that throttle gear 2 is rotated in the clockwise direction (in the valve closing direction) from the default opening position in FIG. 11, the stopper projection 2D of the throttle gear 2 is rotated together with the hook 1D positioned at one end of the default spring 1B, in the clockwise direction. At this time, the short arm part 1C1 as the other end of the default spring 1B, which is stopped by the spring stopper 3B, thereby the hook 1C can not rotate. As a result, the default spring 1B is wound up, and a returning force in the counterclockwise direction (in the valve closing direction) is accumulated.

When the motor is energized so that the throttle gear 2 is rotated in the counterclockwise direction (in the valve opening direction) from the default opening position in FIG. 11, the spring engagement end surface 2E of the throttle gear 2 is rotated together with the long arm part 1C2 positioned at one end of the return spring 1A, in the clockwise direction, and at the same time, the short arm 1C1 (spring hook 1C) is moved away from the spring stopper (default stopper) 3B.

At this time, the hook 1E as an open end of the return pring 1A, which is hooked on the stopper 3C formed on the throttle body 3, is not rotated. As a result, the return spring 1A is wound up, and the returning force in the clockwise direction (in the valve closing direction) is accumulated.

In this embodiment, as the spring with a larger coil diameter can be used as the default spring 1B, the number of turns of the default coil spring coil can be reduced, and the length of the coil spring in the axial direction can be reduced.

On the other hand, as the spring with a smaller coil diameter is used as the return spring with large operation angle, the length of the return spring is prolonged. However, in the case of a small-diameter bearing such as a plane baring or a needle bearing as a bearing to support the throttle shaft, the dead space can be effectively utilized by arranging the return spring around the bearing. As a result, the dimension of projection from the bearing end surface in the axial direction can be reduced.

Third Embodiment 3

Figure 12:
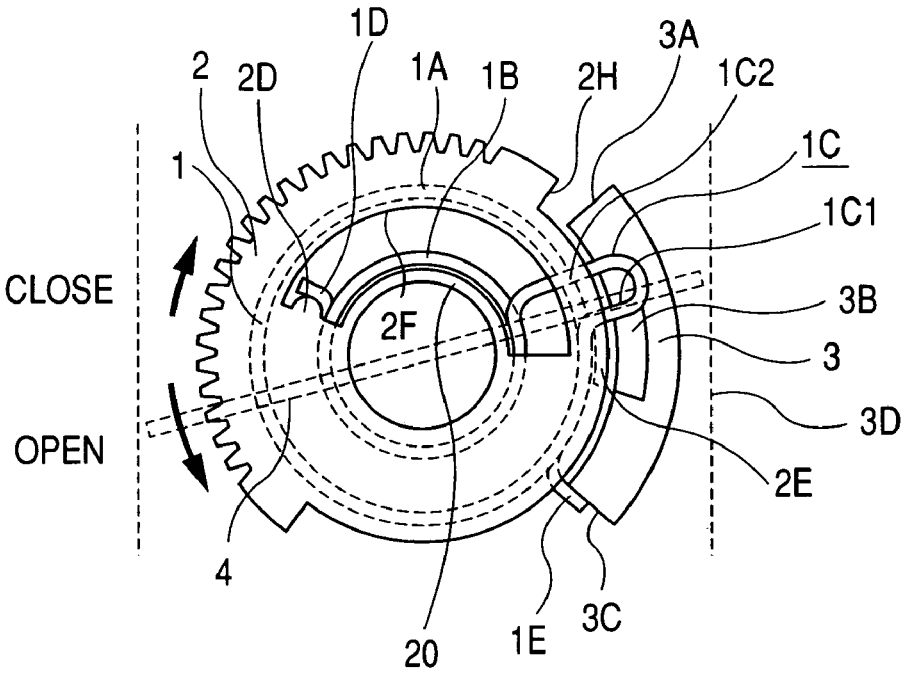
FIG. 12 is an operation explanatory view for explaining the third working example.

FIG. 12 shows a third embodiment of the present invention. Regarding the above-described FIG. 8(*a*), in the present embodiment, the spring engagement end surface 2E of the projection is formed outside the spring with a larger coil diameter so that the spring engagement end surface 2E formed on the throttle gear 2 is engaged with the short arm part 1C1 of the spring hook 1C.

In this arrangement, as only the short arm 1C1 part of the spring hook 1C can serve as two engagement portions, the shapes of the other portions of the spring hook 1C can be freely set.

Forth Embodiment 4

Figure 13:
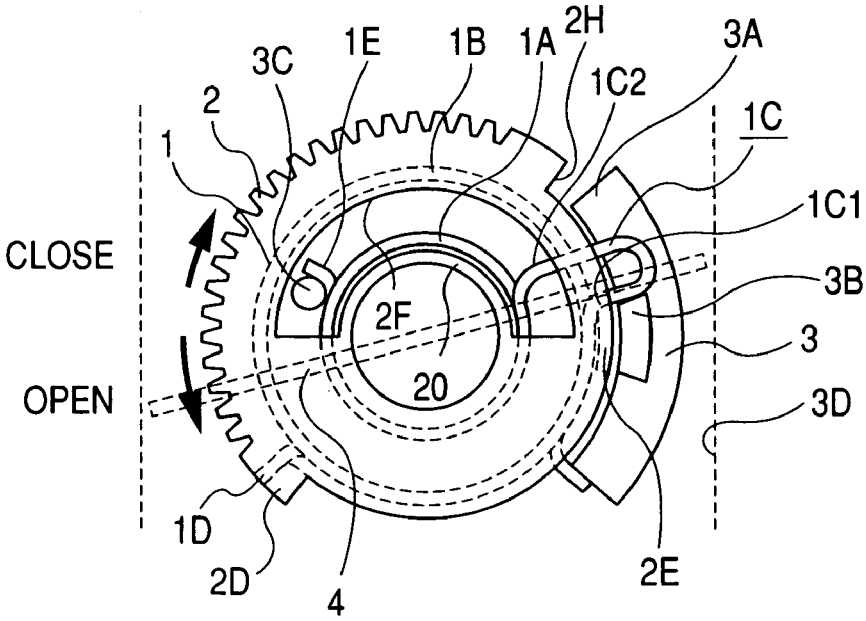
FIG. 13 is an operation explanatory view for explaining the fourth working example.

FIG. 13 shows a forth embodiment 4 of the present invention. In the above-described embodiment in FIG. 11, the spring engagement end surface 2E is arranged outside the default spring 1B as in the case of FIG. 12 so that the spring engagement end surface 2E is engaged with the short arm part 1C1 of the spring hook 1C. In this embodiment, the advantages of the embodiment in FIG. 11 and that of the embodiment in FIG. 12 can be obtained.

Note that in the above embodiments, the torque of the motor is transmitted via the gear mechanism to the throttle shaft, however, the default mechanism can be used in a structure where the throttle valve is directly fixed to the rotor shaft of the motor and the throttle valve is directly rotated by the motor.

According to the embodiments, the arrangement space of the entire spring in the axial direction can be reduced, and by extension, a gear case and the entire throttle body can be downsized and light-weighted.

What is claimed is:

1. A motor-driven throttle valve control device for an internal combustion engine comprising a throttle shaft, a throttle valve fixed to the throttle shaft, and a motor, wherein a torque of the motor is transmitted to the throttle shaft, the throttle valve control device further comprising:

a default stopper provided at a specified opening position from a minimum opening position of the throttle valve;

a default spring which exerting its spring force on the throttle shaft toward a default stopper position in a valve opening direction; and a return spring which acts independently of the default spring to exert its spring force on the throttle shaft in a valve closing direction between the default stopper position and a full open position of the throttle valve, wherein the default spring and the return spring have mutually different coil diameters and are integrated with each other by a double coil spring arrangement in which those springs are formed continuously in a length of spring wire and arranged with overlapped structure in an axial direction so that at least part of one spring with a smaller coil diameter is located inside another with a larger coil diameter.

2. The motor-driven throttle valve control device according to claim 1, wherein a spring hook provided at midpoint between the default spring and the spring hook is stopped with the default stopper when the throttle valve comes to the default position.

3. The motor-driven throttle valve control device according to claim 2, wherein the spring hook projects outside the larger coil diameter spring served as the return spring or the default spring so as to be stopped on the default stopper outside the larger coil diameter spring when the throttle valve is turned up to the default opening position.

4. The motor-driven throttle valve control device according to claim 2, wherein the spring hook is configured as follows when viewed from the larger coil diameter spring: a short arm part to be the larger coil diameter spring side of the spring hook is bent outward in a spring radial direction within the same plane as the winding plane of the spring at an end of the larger coil diameter spring, an end of the short arm part further is bent back toward the smaller larger coil diameter spring within the same plane as the winding plane and continued to an end of the smaller larger coil diameter spring through a long arm part to be the smaller larger coil diameter side of the hook.

5. The motor-driven throttle valve control device according to claim 4, wherein the short arm part contacts with the default stopper when the throttle valve is positioned at the default opening, and the long arm part functions as a portion for transmitting a torque of the motor to the return spring on the more opening side than the default opening position.

6. A motor-driven throttle valve control device for an internal combustion engine, which operates a throttle valve for controlling an intake air flow rate in an internal combustion engine using an electric motor-driven actuator, and which has a default opening setting mechanism that keeps a predetermined throttle valve opening more than a full closed position this opening being defined as a default opening when the electric motor-driven actuator is unenergized, the device comprising a return spring for exerting a spring force in a closing direction to the throttle valve, and a default spring for exerting a spring force to the default opening side from the full closed position of the throttle valve, wherein the coil diameter of the return spring is different from that of the default spring, and at least a part of one spring with a smaller coil diameter of them is located inside the other one of the springs with a larger coil diameter, wherein one end of the spring with a larger coil diameter is movably provided on a throttle shaft, one end of the spring with a smaller coil diameter is movably provided on the throttle shaft, and integrally connected to one end of the spring with a larger coil diameter, and the other end of one of the springs is fixed to an unrotatable fixing member while the other end of one of the springs is fixed to the rotatable throttle shaft.

7. The motor-driven throttle valve control device according to claim 1, wherein the return spring and the default spring are held around the throttle shaft and provided between a throttle gear fixed on the throttle shaft in the motor torque transmitting gear mechanism and a side wall of a throttle body.

8. The motor-driven throttle valve control device according to claim 2, wherein one end of the larger coil diameter spring as the return spring or the default spring is held to a throttle gear, one end of the smaller coil diameter spring is held to the throttle gear and integrally connected with one end of the larger coil diameter spring, and one of the other ends of the springs is held to a throttle body wall while another of the other ends is held to the throttle gear.

9. The motor-driven throttle valve control device according to claim 2, wherein one end of the larger coil diameter spring as the return spring or the default spring is held to a throttle gear, one end of the smaller coil diameter spring is held to the throttle gear and integrally connected with one end of the larger coil diameter spring, one of the other ends of the springs is held to the throttle gear, and in this status, the return spring and the default spring are integrally assembled in the throttle gear.

10. The motor-driven throttle valve control device according to claim 1, wherein a non-contact throttle position sensor is provided inside of a duplex winding coil structure of the larger coil diameter spring and the smaller coil diameter spring.

* * * * *